US006020679A

United States Patent [19]

Yasuda

[11] Patent Number: 6,020,679

[45] Date of Patent: Feb. 1, 2000

[54] SHADOW MASK TYPE COLOR CATHODE RAY TUBE AND SHADOW MASK

[75] Inventor: Tsukasa Yasuda, Shiga, Japan

[73] Assignee: NEC Corporation, Tokyo, Japan

[21] Appl. No.: 09/047,499

[22] Filed: Mar. 25, 1998

[30] Foreign Application Priority Data

Mar. 26, 1997 [JP] Japan ..... 9-073481

[51] Int. Cl.[7] ..... H01J 29/07

[52] U.S. Cl. ..... 313/403

[58] Field of Search ..... 313/403, 402, 313/407, 408

[56] References Cited

U.S. PATENT DOCUMENTS

| | | | |
|---|---|---|---|
| 3,888,673 | 6/1975 | Suzuki et al. | 313/474 |
| 3,890,151 | 6/1975 | Suzuki et al. | 430/24 |
| 3,947,718 | 3/1976 | van Lent | 313/403 |
| 4,049,451 | 9/1977 | Law | 313/474 |
| 4,665,339 | 5/1987 | Masterton et al. | 313/403 |

FOREIGN PATENT DOCUMENTS

| | | | |
|---|---|---|---|
| 8-8060 | 1/1996 | Japan | H01J 9/227 |
| 8-8061 | 1/1996 | Japan | H01J 9/227 |
| 8-8062 | 1/1996 | Japan | H01J 9/227 |

*Primary Examiner*—Michael H. Day
*Attorney, Agent, or Firm*—Young & Thompson

[57] ABSTRACT

A shadow mask type color cathode ray tube prevents rotation of light emitted through slots in a shadow mask that would form a zigzagged stripe during an exposure of a fluorescent film. The slots are rotated at an angle $\theta_1$ about a center of the slots in a direction opposite to the direction of rotation, whereby light passing through the slots is offset, so that a vertical striped fluorescent surface can be thus obtained.

3 Claims, 5 Drawing Sheets

SHADOW MASK TYPE COLOR CATHODE RAY TUBE AND SHADOW MASK

BACKGROUND OF THE INVENTION

1. Field of the Invention

The present invention relates to a shadow mask for use in a shadow mask type color cathode ray tube and a shadow mask type color cathode ray tube using such a shadow mask.

2. Description of the Prior Art

As shown in FIG. 1A, a shadow mask type color cathode ray tube comprises a panel 4 coated with a fluorescent film 3 in which three-color lengthwise successive fluorescent stripes (R, G, B) are arranged in many arrays in a direction perpendicular to scan lines of electron beams emitted from electron guns 1 through a shadow mask 2 to an inner surface of the panel, wherein a generally conical funnel 6 having a tubular neck portion 7 is connected to the panel 4 whereby a vacuum container is formed.

The three electron guns 1 are attached in an in-line arrangement in the neck portion 7. A deflecting yoke 5 for deflecting the electron beams is arranged on an outer periphery of the funnel 6. The shadow mask 2, in which slots 12 as shown in FIG. 1B for selectively transmitting the electron beams are formed, is arranged opposite to the fluorescent film 3 on the inner surface of the panel 4.

In the above-constituted shadow mask type color cathode ray tube, the three electron beams emitted from the electron guns 1 are deflected by a horizontal deflection magnetic field and a vertical deflection magnetic field generated by the deflecting yoke 5. The beams are then scanned over a fluorescent surface of the fluorescent film 3, and they collide with respective corresponding color fluorescent substances through the slots 12 in the shadow mask 2, whereby the fluorescent substances are excited and allowed to emit a light, so that a color image is displayed.

For such a shadow mask type color cathode ray tube, when the panel is covered with the striped fluorescent film 3 (hereinafter referred to as the "fluorescent stripe") parallel to a longitudinal direction of the slots 12 described above, generally used is an exposing method as disclosed in U.S. Pat. No. 4,049,451 in which a line source is arranged parallel to the longitudinal direction of the slots 12 and a perforated portion in the mask is used. However, in this method, due to a geometry of the shadow mask 2 and the panel 4 themselves, the light from the light source projected on the panel inner surface is rotated, and a light 13 passing through the shadow mask is inclined as shown in FIG. 2. Thus, a fluorescent stripe 9 constituting the resultant fluorescent film 3 is zigzag-patterned as shown in FIG. 2, so that an image quality is considerably deteriorated.

Various methods for improving the deterioration of quality due to this zigzag have been proposed. One of the methods is disclosed in U.S. Pat. No. 3,888,673 and 3,890,151 in which an exposure is performed by a combination of the rocking line source and a movable masking shield. However, in this method, although the exposure is performed by changing an angle of the light source and a position of the masking shield whereby an optimization of the exposure can be attempted over the inner surface of the panel, there is caused a problem in which an exposing time is considerably extended.

The further improved method is the method in which a negative meniscus lens 10 is arranged between a line source 8 and the shadow mask 2 as shown in FIG. 3, disclosed in Japanese Patent Application Laid-open No. 8-8060, No. 8-8061, No. 8-8062 or the like. This negative meniscus lens 10 has different curvatures on the inner and outer surfaces thereof. The negative meniscus lens 10 is intended for previously correcting an amount of rotation to a desired amount when the light passing through the slot 12 is emitted on the inner surface of the panel 4.

On the other hand, in the methods disclosed in Japanese Patent Application Laid-open No. 8-8060 through No. 8-8062 described above, when the fluorescent film 3 of the cathode ray tube is formed, the fluorescent film 3 must be formed so that it may match the position in which the electron beams emitted from the electron guns pass through the slots 12 in the shadow mask 2 and are emitted onto the inner surface of the panel 4. Thus, during the exposure, a correcting lens 11 having a complicated curved surface determined by a higher order function is arranged between the line source 8 and the shadow mask 2, whereby the optimization of the formation of the fluorescent film 3 is attempted. However, even if this correcting lens 11 is used, when the light passes through the correcting lens 11, the light, which passes through the negative meniscus lens 10 and is once optimized, is again changed. As a result, the light emitted onto the inner surface of the panel 4 is rotated, so that there is a shortcoming in which the zigzagged fluorescent stripe 9 is formed as shown in FIG. 2 and the zigzag is not sufficiently improved.

SUMMARY OF THE INVENTION

It is an object of the present invention to provide a shadow mask useful for forming fluorescent stripes (R, G, B) on an inner surface of a panel of a shadow mask type color cathode ray tube in such a manner that they are not zigzagged and a shadow mask type color cathode ray tube having such a shadow mask.

A shadow mask type color cathode ray tube of the present invention comprises: three electron guns arranged in an in-line arrangement; a panel including a striped fluorescent film in a direction perpendicular to the arrangement of these electron guns; and a shadow mask in which slots are rotated about a center of the slots in a longitudinal direction of the slots.

According to the above constitution, when a light beam emitted from a line source passes through a correcting lens, a deviation is caused. On the other hand, since the slots in the shadow mask are previously rotated about the center of the slots in the direction opposite to this rotation of the light beam, an amount of deviation can be offset. The fluorescent film, which is parallel to longitudinal axes of the slots and not zigzagged but striped, can be thus formed on the inner surface of the panel.

Moreover, the rotation of the slots about the center of the slots is determined not only by correcting the amount of rotation by the correcting lens but also by estimating the amount of rotation which cannot be completely corrected by a negative meniscus lens, whereby the fluorescent film can be further improved in quality by a synergistic effect of the correction and the estimation.

DETAILED DESCRIPTION OF THE PREFERRED EMBODIMENTS

The present invention will be described with reference to the accompanying drawings.

Figure 4A:
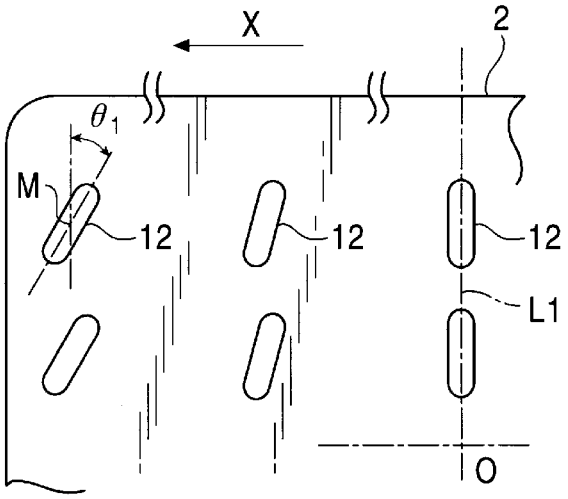
FIG. 4A is a plan view of the slots in the shadow mask according to a first embodiment of the present invention.
Figure 4B:
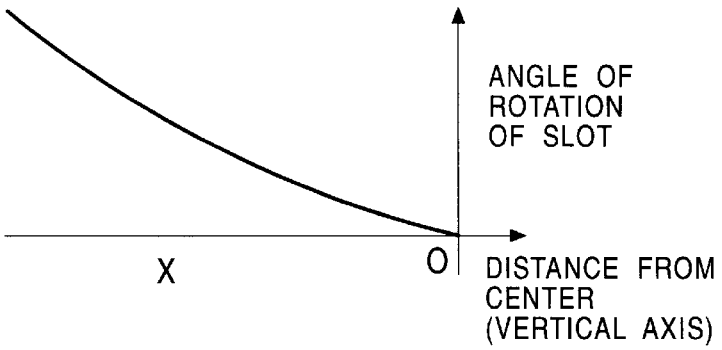
FIG. 4B is a graph showing a change in an angle of rotation of the slots in the shadow mask according to the first embodiment.

FIG. 4A is an enlarged view of a shadow mask 2 in which slots 12 are rotated about a center M of the slots 12 in a shadow mask type color cathode ray tube. An angle $\theta_1$ of rotation of the slots 12 is herein determined by a function as shown in FIG. 4B in which a horizontal distance from a center position of a perforated area in the mask is set as a parameter.

Figure 1A:
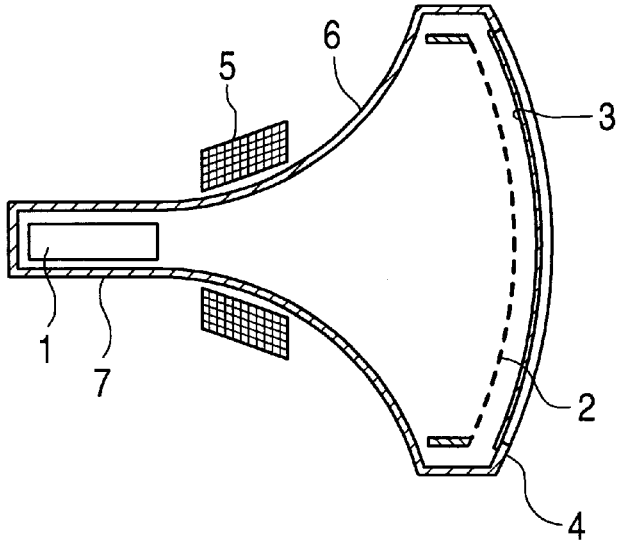
FIG. 1A PRIOR ART
FIG. 1A is a schematic cross sectional view of a color cathode ray tube.
Figure 1B:
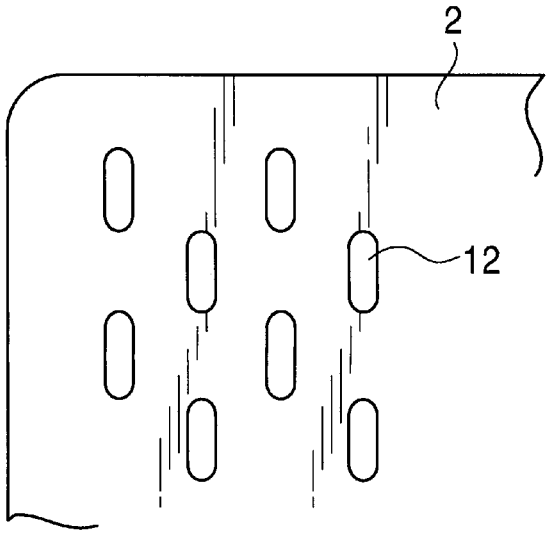
FIG. 1B PRIOR ART
FIG. 1B is a plan view of slots formed in a shadow mask.
Figure 2:
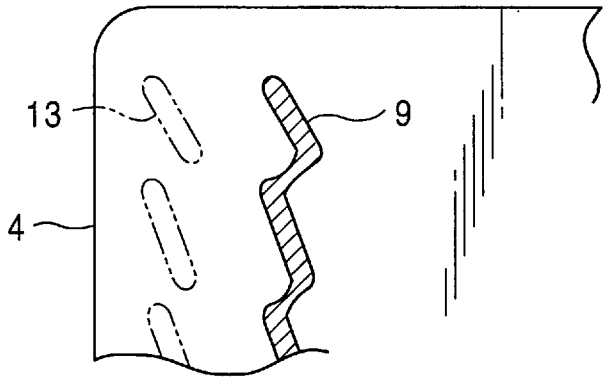
FIG. 2 PRIOR ART
FIG. 2 is a plan view of a transmitted light emitted on a panel and a zigzag of a formed fluorescent film stripe during an exposure.
Figure 3:
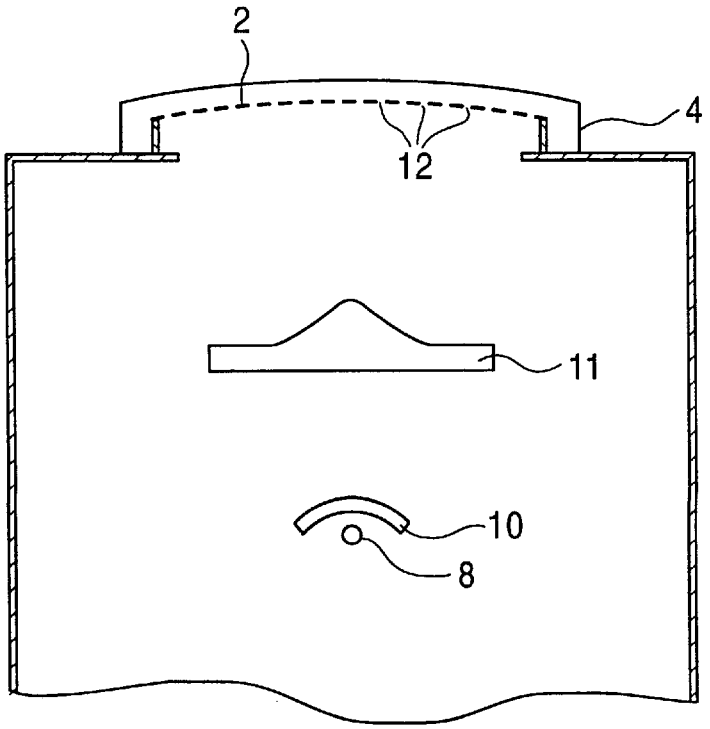
FIG. 3 shows a constitution of an exposing unit of the color cathode ray tube.
Figure 4C:
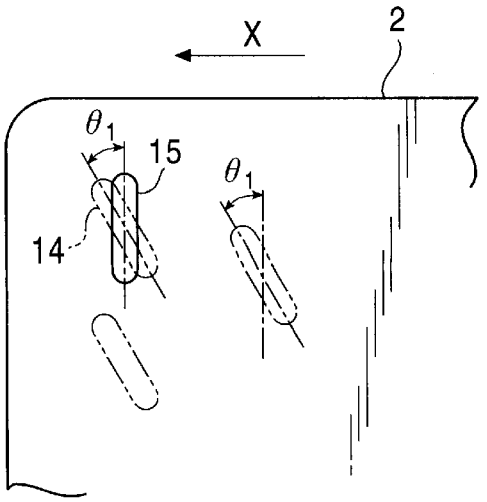
FIG. 4C is a plan view of the rotation of the light passing through the shadow mask before and after the first embodiment is implemented.

In an arrangement of the prior-art cathode ray tube shown in FIG. 3, when a light passes through a correcting lens, passes through the slots 12 in the shadow mask 2 and reaches an inner side of a panel 4, the angle $\theta_1$ of clock-wise rotation is formed in a vertical direction as shown in FIG. 4C. On the other hand, according to this embodiment, as shown in FIG. 4A, the slots 12 in the shadow mask 2 are previously rotated in an opposite (counterclockwise) direction at the angle $\theta_1$, whereby the light reaching an inner surface of the panel 4 can be corrected from a light 14 passing through the shadow mask to a light 15 passing through the shadow mask as shown in FIG. 4C. It is thus possible to form a high-quality fluorescent film 3 in which a fluorescent stripe is not zigzagged.

TABLE 1

| Horizontal coordinate X [mm] | Angle $\theta_1$ of rotation of slots [°] |
|---|---|
| 0 | 0 |
| 70 | 2 |
| 140 | 5 |

Table 1 shows an example of the angle $\theta_1$ of rotation of the slots with respect to an X-coordinate X of the slots 12 from a vertical reference line L1 passing through the center (origin) of the perforated area in the shadow mask 2 shown in FIG. 4A.

The angle $\theta_1$ of rotation of the slots can be determined by the following equation (1) as a result of a simulation.

$$\theta_1[°]=-1.04123e^{-4}X^4+4.59184e^{-4}X^2 \quad (1)$$

Figure 5A:
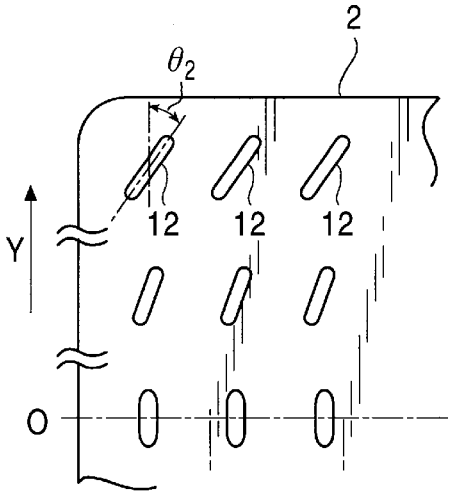
FIG. 5A is a plan view of the slots in the shadow mask according to a second embodiment of the present invention.
Figure 5B:
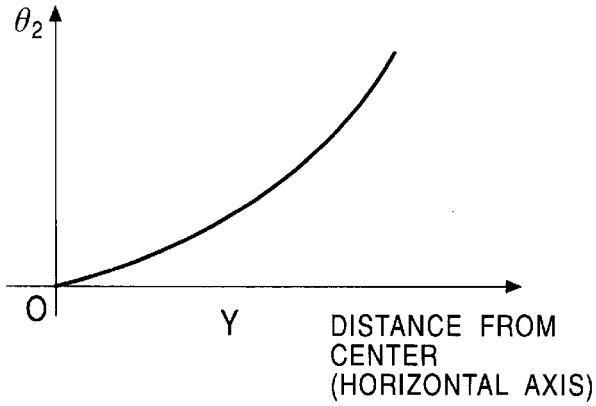
FIG. 5B is a graph showing the change in the angle of rotation of the slots in the shadow mask according to the second embodiment.

FIG. 5A is an enlarged view of the shadow mask according to a second embodiment of the present invention. This embodiment is the same as the first embodiment except that the function for determining the angle of rotation of the slots of the first embodiment is defined by setting, as the parameter, a vertical distance from the center position of the perforated area in the mask shown in FIG. 5B.

Figure 5C:
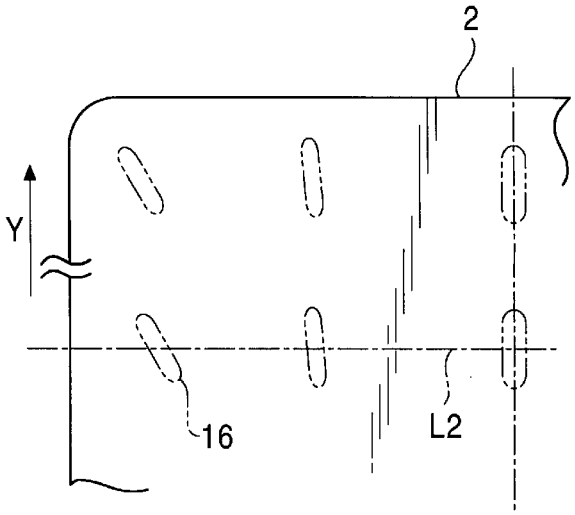
FIG. 5C is a plan view of the rotation of the light passing through the shadow mask before the second embodiment is implemented.

In this embodiment, the angle of rotation of the slots 12 is constant in a horizontal direction of the perforated area in the mask. Thus, when the light that passed through the correcting lens is rotated so that a light 16 passing through the shadow mask may be changed in the angle in a horizontal array, for example, as shown in FIG. 5C, the second embodiment can more exactly correct the rotation than the first embodiment.

TABLE 2

| Horizontal coordinate X [mm] | Angle $\theta_2$ of rotation of slots [°] |
|---|---|
| 0 | 0 |
| 52.5 | 2 |
| 105 | 4.67 |

Table 2 shows an example of this embodiment and shows the angle $\theta_2$ of rotation of the slots with respect to a Y-coordinate Y of the slots 12 from a horizontal reference line L2 passing through the center of the perforated area in the shadow mask 2. In this case, the angle $\theta_2$ of rotation of the slots can be determined by the following equation (2) as a result of the simulation.

$$\theta_2[°]=-3.66914e^{-4}Y^4+8.28086e^{-4}Y^2 \quad (2)$$

Figure 6A:
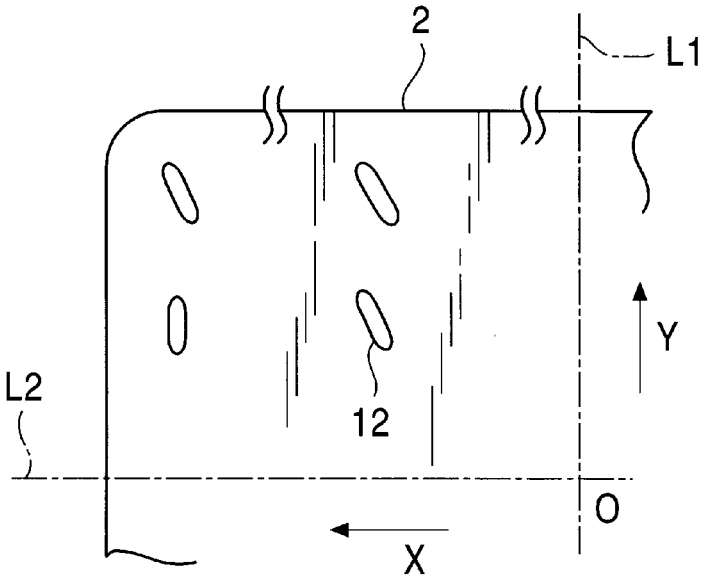
FIG. 6A is a plan view of the slots in the shadow mask according to a third embodiment.

FIG. 6A is an enlarged view of the shadow mask according to a third embodiment of the present invention.

This embodiment is also the same as the first and second embodiments except that the function for determining the angle of rotation of the slots is determined by two parameters of a horizontal position X and a vertical position Y of the center of the slots when the center of the perforated area in the mask is set as an origin O.

Figure 6B:
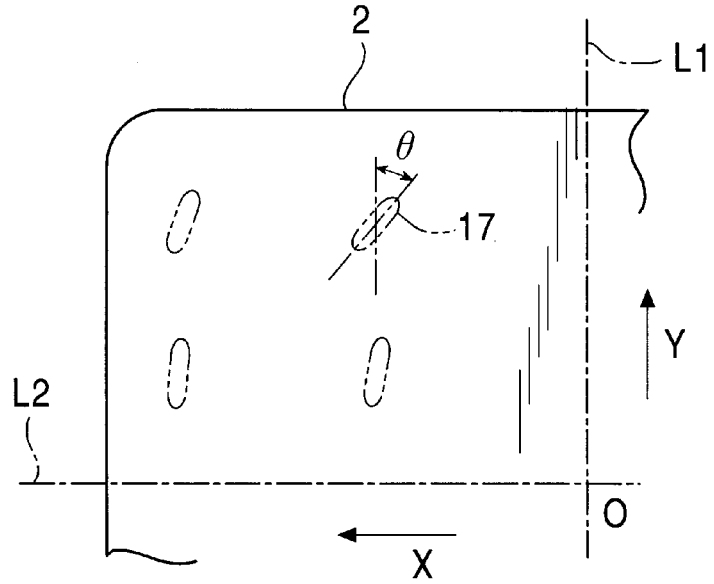
FIG. 6B is a plan view of the rotation of the light passing through the shadow mask before the third embodiment is implemented.

In this embodiment, when the zigzag is reduced by uniformly rotating all the slots in the horizontal array or vertical array in the perforated area in the mask in the same manner as the above-mentioned embodiments, the zigzag, for example, shown in FIG. 6B, cannot be corrected. In consideration of this fact, an angle θ of rotation of the slots 12 is defined by the function in which the positions of the slots 12 are set as the parameter, whereby an exact correction can be carried out over the perforated area in the mask.

TABLE 3

| Coordinates of slots [mm] | | Angle θ of rotation |
|---|---|---|
| X | Y | of slots [°] |
| −140 | 150 | 7.0 |
| −140 | 52.5 | 4.9 |
| −70 | 105 | 16.0 |
| −70 | 52.5 | 10.2 |
| 0 | 0 | 0 |

Table 3 shows an example of the angle θ of rotation of the slots about a coordinate X, Y of the center of the slots 12. For such a zigzag, as a result of the simulation, the angle θ of rotation is expressed by a higher order function such as the following equation (3), whereby a light 17 passing through the shadow mask as shown in FIG. 6B can be corrected to the light 15 passing through the shadow mask shown in FIG. 4C.

$$\theta[^\circ]=1.954541eX^2Y+6.31286e^{-4}X+4.08536e^3XY+1.08033e^{-1}X+9065e^5Y \quad (3)$$

Although a method of using a negative meniscus lens and a correcting lens as shown in FIG. 3 for coating the inner surface of the panel of the cathode ray tube with the fluorescent film has been described in the above embodiments, the shadow mask according to the present invention is effective for preventing the fluorescent stripe from zigzagging without the use of the negative meniscus lens and the correcting lens.

As described above, the present invention has the following effect. That is, in the cathode ray tube having the shadow mask in which slot arrays are arranged in parallel in the perforated area therein, in order to prevent the quality from deteriorating due to the zigzag caused during forming the fluorescent film by the exposure, the rotation of the light source resulting from a geometry of the panel and the mask is corrected by the negative meniscus lens. After that, the rotation is performed by the correcting lens having a complicated curved surface in such a manner that the slots in the shadow mask are formed so that they may be rotated about the center thereof at the angle determined by the higher order function in which the coordinate with respect to the center of the perforated area in the mask is set as the parameter, whereby it is possible to form the high-quality striped fluorescent film which is not zigzagged but parallel to the arrangement of the slots.

What is claimed is:

1. A shadow mask for a color cathode ray tube, comprising a plurality of slots whose longitudinal axes are inclined at a first angle with respect to a vertical axis that passes through a center of the shadow mask, the first angle being equal to $-1.0412e^{-4}x^{-4}+4.59184e^{-4}x^2$, where x is the distance in millimeters from the vertical axis.

2. A shadow mask for a color cathode ray tube, comprising a plurality of slots whose longitudinal axes are inclined at a first angle with respect to a vertical axis that passes through a center of the shadow mask, the first angle being equal to $-3.66914e^{-4}y^{-4}+8.28086e^{-4}y^2$, where y is the distance in millimeters from a horizontal axis that passes through the center of the shadow mask.

3. A shadow mask for a color cathode ray tube, comprising a plurality of slots whose longitudinal axes are inclined at a first angle with respect to a vertical axis that passes through a center of the shadow mask, the first angle being equal to $1.954541ex^2y+6.31286e^{-4}x^2+4.08536e^3xy+1.08033e^{-1}x+1.9065e^5y$, where x is the distance in millimeters from the vertical axis and y is the distance in millimeters from a horizontal axis that passes through the center of the shadow mask.

* * * * *